US007942723B2

(12) United States Patent
Fildan et al.

(10) Patent No.: US 7,942,723 B2
(45) Date of Patent: May 17, 2011

(54) BACK ADJUSTER FOR BRASSIERE

(75) Inventors: Gerhard Fildan, Vienna (AT); Karl Wanzenböck, Leobersdorf (AT)

(73) Assignee: Fildan Accessories (HK) Ltd, Kwun Tong Kowloon (HK)

( * ) Notice: Subject to any disclaimer, the term of this patent is extended or adjusted under 35 U.S.C. 154(b) by 649 days.

(21) Appl. No.: 12/009,606

(22) Filed: Jan. 18, 2008

(65) Prior Publication Data

US 2009/0186555 A1 Jul. 23, 2009

(51) Int. Cl.
*A41C 3/00* (2006.01)

(52) U.S. Cl. ..... 450/58; 24/587.11; 24/585; 24/616

(58) Field of Classification Search ..... 24/170, 24/585, 616, 615, 685 K, 587.11, 593.11, 24/191; 450/58, 9, 17, 25, 28, 33, 34, 63, 450/71, 73, 77, 79, 82, 86; 2/338, 336, 310–312, 2/96

See application file for complete search history.

(56) References Cited

U.S. PATENT DOCUMENTS

| | | | | |
|---|---|---|---|---|
| 2,171,448 | A * | 8/1939 | Holtz | 24/593.11 |
| 5,579,563 | A * | 12/1996 | Sim | 24/587.12 |
| 5,588,186 | A * | 12/1996 | Ko | 24/587.12 |
| 6,211,889 | B1 * | 4/2001 | Stoutamire | 345/442 |
| 6,427,291 | B1 * | 8/2002 | Kim | 24/191 |
| 6,715,449 | B1 * | 4/2004 | Jordan | 119/863 |
| 6,898,826 | B2 * | 5/2005 | Draper et al. | 24/68 SK |

* cited by examiner

*Primary Examiner* — Gloria Hale
(74) *Attorney, Agent, or Firm* — Andrew Wilford

(57) ABSTRACT

A length adjuster for connection between two parts of a garment has a flexible tape having an outer end adapted for fixing to one of the garment parts and formed with a longitudinally extending row of grooves and an inner end. A buckle has a base formed with a seat and an upper face from which projects a tooth. A clamp has a lower face turned toward the upper face and pivotal on the base between a position closely juxtaposed with the tooth and a position farther away from the tooth. The tape extends through the buckle between the faces with the grooves open toward and fittable with the tooth and with the inner end fixed in the seat. The tape forms a loop to a side of the buckle opposite the outer end. Structure forms an eye through which the loop passes and through which the tape can slide.

19 Claims, 3 Drawing Sheets

10
13
30
14
20
13
50
20
10
14
30

50
13
30
13
20
10
14
30

51
13
20
30
13
IV
10
14
30

30
51
20
10
P
13
30

52
20
30
13
VI
10
14
30

20
P
14
30
13
15
10
30

BACK ADJUSTER FOR BRASSIERE

FIELD OF THE INVENTION

The present invention relates to a strap-type length adjuster for a garment. More particularly this invention concerns an adjuster for a brassiere back.

BACKGROUND OF THE INVENTION

A brassiere or swimsuit top typically has a pair of cups from which so-called wings extend around the back of the wearer. The ends of the wings are typically joined together at a closure that is also usually set up to adjust the length of the brassiere back.

The most common back adjuster/closure is comprised of at least one row of eyes provided on one of the wings and at least one hook on the other wing. Big brassieres have several rows of eyes and a complementary number of hooks. The fit of the brassiere is adjusted by determining which eye (or set of eyes) the hook (or hooks) is/are fitted to.

This arrangement has several disadvantages. To start with the user must determine which eyes to use each time the garment is donned, even though the setting is rarely changed. Even if the brassiere or garment has a front closure, so that the rear adjuster does not have to be opened up to take off or put on the garment, the hook/eye system can open relatively easily when not under tension. When such a garment is washed, the hooks can get caught in and damage other items in the load of wash. In addition the assembly is fairly bulky and includes several metal or hard plastic parts that form a perceptible lump under the wearer's outer garments, a problem aggravated by the fact that only part of the adjuster is actually doing anything.

OBJECTS OF THE INVENTION

It is therefore an object of the present invention to provide an improved strap-type adjuster.

Another object is the provision of such an improved strap-type adjuster that overcomes the above-given disadvantages, in particular that is particularly usable for a back of a brassiere.

A further object is the provision of such an adjuster that can be set and left set between wearings, and that even will stay set during normal handling and, for instance, laundering off the wearer.

SUMMARY OF THE INVENTION

A length adjuster for connection between two parts of a garment has according to the invention a longitudinally elongated flexible tape having an outer end adapted for fixing to one of the garment parts and formed with a longitudinally extending row of grooves and an inner end. A buckle has a base formed with at least one seat and an upper face from which projects a tooth. A clamp has a lower face turned toward the upper face and pivotal on the base between a position closely juxtaposed with the tooth and a position less closely juxtaposed with the tooth. The tape extends through the buckle between the faces with the grooves open toward and fittable with the tooth and with the inner end fixed in the seat. The tape forms a loop to a side of the buckle opposite the outer end. Structure forms an eye through which the loop passes and through which the tape can slide. In the latched position the clamp presses the tape against the upper face of the base with the tooth fitted in one of the grooves to arrest the tape. The tape is slidable in the release position between the clamp and the base.

Such an arrangement can be made very compact and, when combined with a separate closure, can be of the set-it-and-forget-it type, not needing resetting each time the garment incorporating it is donned. This is very advantageous when the adjuster according to the invention is used in a garment such as a brassiere or inflatable cast requiring a very exact fit. In the case of a brassiere, its back wings form the two parts.

According to the invention the tooth has an angled flank turned toward the outer end and a substantially perpendicular flank turned toward the loop. Thus in the release position the tape can slide over the angled flank of the tooth. In the opposite direction the tape can only slide in the release position. The angled structure makes it possible to adjust for tightening simply by pulling the tape from the loop side through the buckle. Tension in the opposite direction will, unless the clamp is being positively held in the release position, frictionally entrain the clamp back into the latched position for self-locking action.

The clamp according to the invention is U-shaped and has a crosspiece forming the lower face and a pair of arms forming with the base a pivot. The base forms outer and inner eye slots flanking the upper face. The inner end of the tape passes through both of the slots.

The seat according to the invention is on the upper face and the base has a lower face normally turned toward a wearer of the garment and against which the tape bears. Thus the normally soft tape substantially holds the buckle out of direct contact with the wearer of the garment.

The grooves are elongated substantially perpendicular to the tape, and the tooth is elongated fittable in the grooves. This gives a good perch of the tooth in the tape for solid holding action.

The tape can have flat faces or can be formed with a frame ridge around the grooves. In addition it is made of a longitudinally inelastic strip, by which is meant an elongated normally textile structure that can flex, fold, and bend easily, but that can withstand considerable longitudinal tension without elongating. Such a tape can be made as a three-layer laminate with a core of, for instance, a strong polyamide mesh, and two outer layers of bonded-on closed-cell foam.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

As seen in FIGS. 1-6 the adjuster/closure system according to the invention basically comprises at least one step tape 10 and at least one buckle 20, connected here between a pair of back wings 30 of a brassiere. It is, of course, within the scope of this invention to use the system of this invention in other contexts, for instance on other garments, which term is here intended to include medical and prosthetic devices that may need to be adjustable. Normally the system of this invention is used under clothing and normally also directly against the skin, although use, for instance, to secure a walker boot or inflatable cast is within the scope of this invention.

Figure 1:
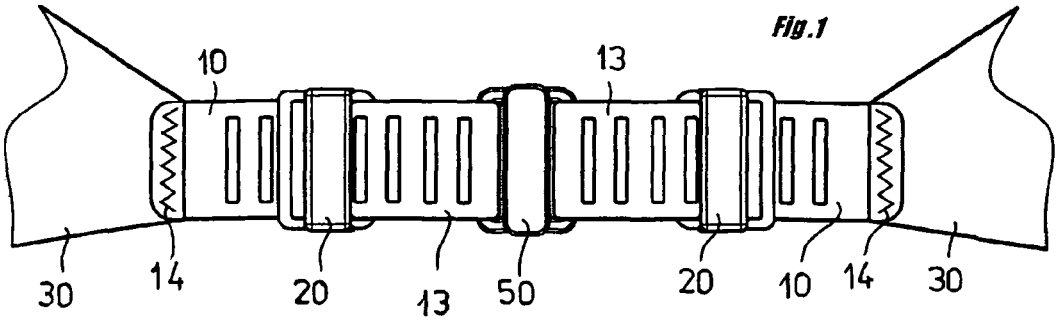
FIG. 1 is a rear view of the adjuster of this invention in a symmetric arrangement with central closure.

FIG. 1 shows a symmetrical back adjuster with a central closure. It has a standard brassiere closure 50 in the center, flanked symmetrically by two step tapes 10 each having an outer end 14 secured to a respective brassiere wing 30, a buckle 20, and an inner loop end 13 engaged with a respective separable part of the closure 50. This system provides a very wide range of adjustment.

Figure 2:
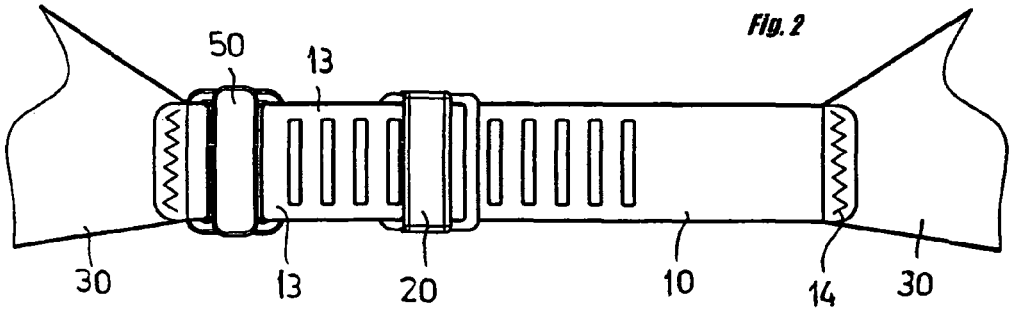
FIG. 2 is a rear view of the adjuster with one-sided closure.

FIG. 2 is a simpler system with a single step tape 10 whose outer end 14 is connected to one of the wings 30 and whose loop end 13 carries a single buckle 20, with the loop end 13 engaged through a standard closure 50 connected to the other wing 30.

Figure 3:
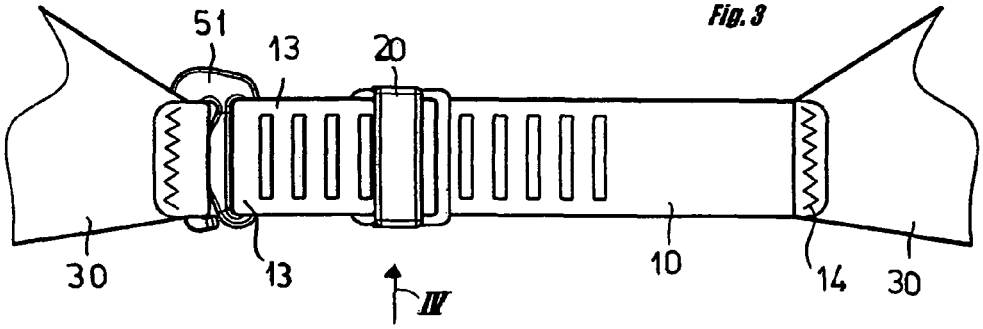
FIG. 3 is a rear view of the adjuster with a swan-hook closure.
Figure 4:
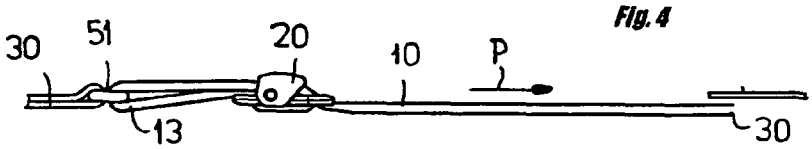
FIG. 4 is an edge view in the direction of arrow IV of FIG. 3.

FIGS. 3 and 4 show a system similar to FIG. 2, but with a swan-hook closure 51.

Figure 5:
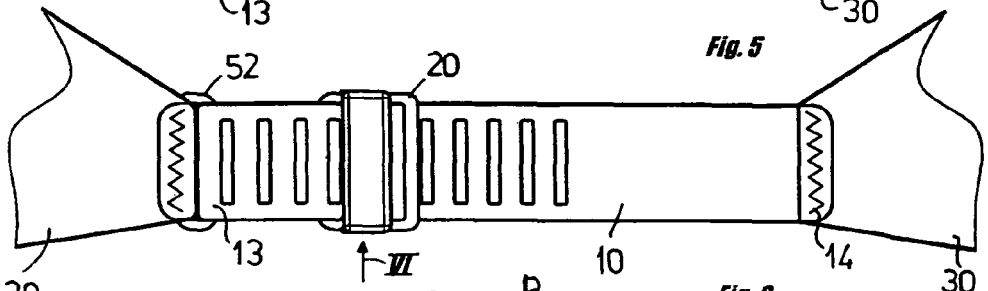
FIG. 5 is a rear view of an adjustment-only adjuster according to the invention.
Figure 6:
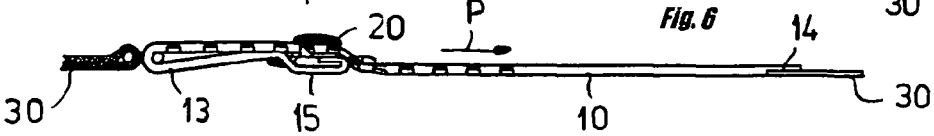
FIG. 6 is an edge view partly in the direction of arrow VI of FIG. 5 and partly in longitudinal section.

FIGS. 5 and 6 show a system with only a single step tape 10 fixed to one of the wings 30 and looped through a simple D-ring 52 or the like fixed to the other wing 30, with a single buckle 20. This is the minimal configuration according to the invention.

Figure 7:
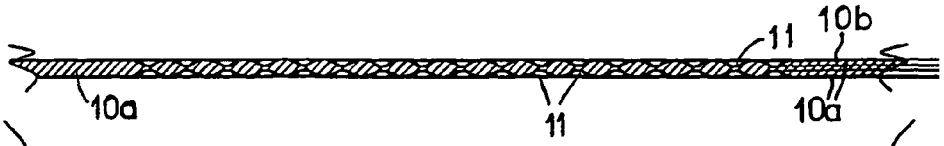
FIG. 7 is a longitudinal section through a cushioned-foam step tape according to the invention.
Figure 8:
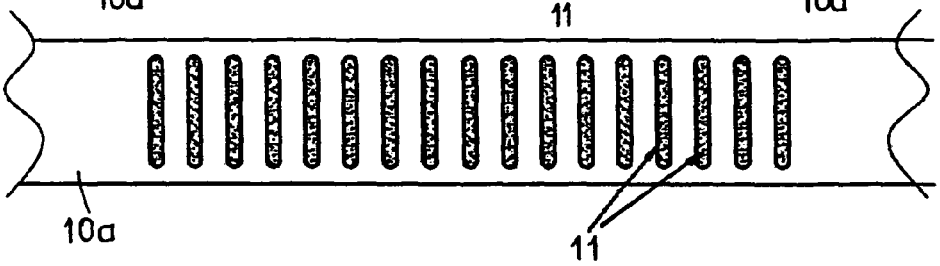
FIG. 8 is a plan view of the tape of FIG. 7.

A typical step tape 10*a* is shown in FIGS. 7 and 8. It is formed of a cushioned-foam tape, that is a tape typically having two surface skins of flexible smooth plastic bonded to opposite faces of a core of micropore closed-cell foam. It is formed with a row of transversely extending grooves 11 on both faces. The grooves 11 are uniformly spaced, extend transversely of the tape 10*a*, and end short of its longitudinal edges. Such grooves are easily formed by pressing an appropriately shaped hot die against the tape, which of course is made of thermoplastic resins. Such a tape can easily be stitched and/or welded to a brassiere wing 30.

Figure 9:
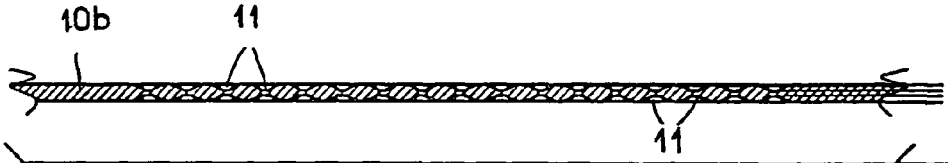
FIGS. 9 and 10 are views like FIGS. 7 and 8 of a cushioned-foam step tape with framed grooves.
Figure 10:
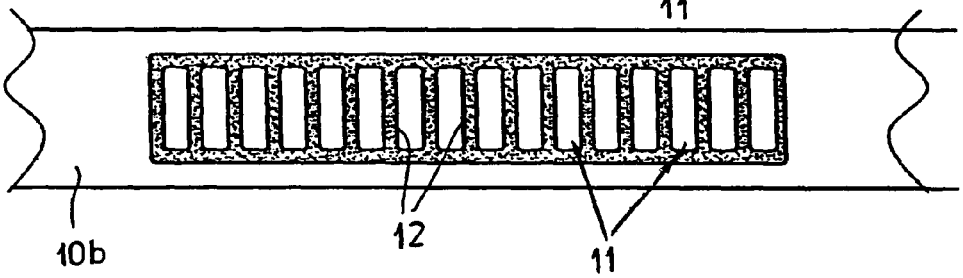

The tape 10*b* of FIGS. 9 and 10 is of the same general construction as in FIGS. 7 and 8, except that it is compressed to form a frame 12 around the grooves 11, that is each groove 11 is surrounded by a raised ridge.

Figure 11:
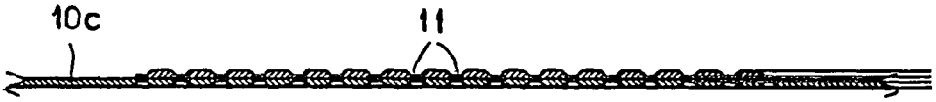
FIGS. 11 and 12 are views like FIGS. 7 and 8 of a laminated step tape.
Figure 12:
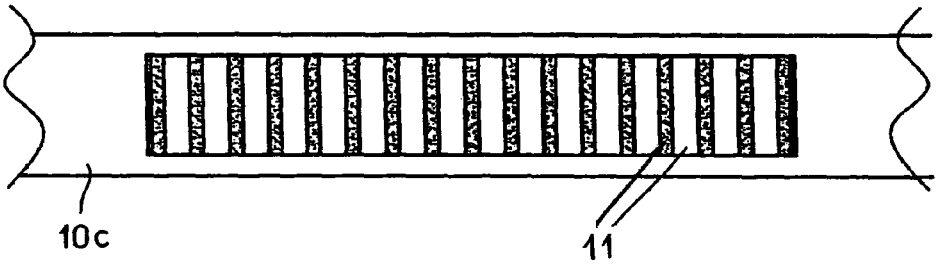

The tape 10*c* of FIGS. 11 and 12 is a laminated tape having the grooves 11 with no frames.

Figure 13:
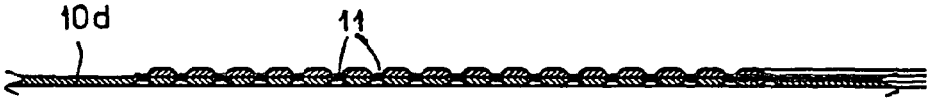
FIGS. 13 and 14 are views like FIGS. 7 and 8 of a laminated step tape with framed grooves.
Figure 14:
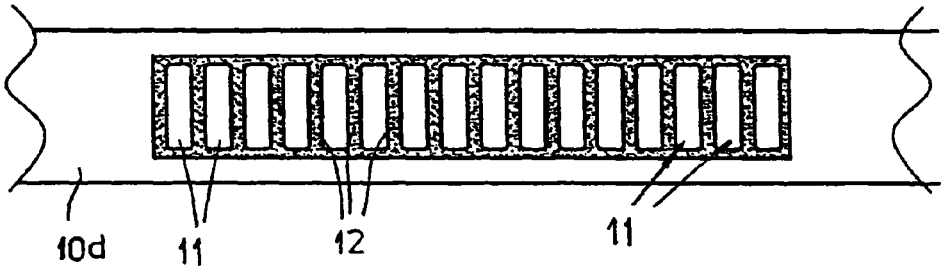

In FIGS. 13 and 14 the laminated tape has a frame 12 around the grooves 11.

Figure 20:
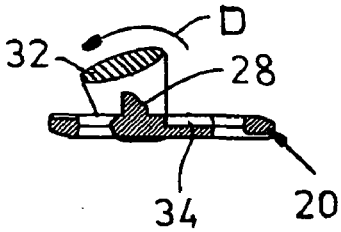
FIG. 20 is a view like FIG. 16, but with the clamp of the buckle in a release position.

FIGS. 15-20 show the buckle 20 according to the invention, in the latched position everywhere except FIG. 20 where it is in the release position. It is made of a durable plastic and has only two injection-molded parts, namely a base 21 and a pivotal clamp 22. As shown in FIGS. 4 and 6 each tape 10 is passed through the buckle 21 to form the inner loop 13 and has on the other side of the buckle 20 the attached outer end 14.

The base 21 has a pair of elongated rings 23 and 24 forming a pair of parallel throughgoing elongated eye slots 25 and 26. Midway between the eyes 25 and 26 the base 21 has a crosspiece 27 formed with an upstanding ridge or sawtooth 28, and at each end the crosspiece 27 forms a pair of coaxial pivot pins 29 defining an axis A. The eye 25 is between the loop 13 and the eye 24 as described in more detail below. The tooth 28 has an inclined flank directed toward the loop 13 and a perpendicular flank directed away from the loop 13 for reasons also described below.

The clamp 22 has a crosspiece 33 from whose ends extend a pair of arms 30 formed with holes 31 that can be snapped over the pins 28 so that the clamp 22 can pivot on the base 21 about the axis A. In the use position shown in FIG. 16, the crosspiece 33 of the clamp 22 forms with the crosspiece 27 of the base 21 a passage 32 that is of a thickness equal to about the thickness of the tape 10, except at the tooth 28 where it is restricted to a dimension much narrower than even a single thickness of the tape 10. The tape 10 is typically 0.60 to 0.70 mm thick and about 18 or 19 mm wide. The buckle 20 has an overall length L equal to about 15.0 mm and a thickness T of about 5.25 mm.

As again shown in FIGS. 4 and 6 the tape 10 extends from its attached outer end 14 up through the one eye 26, then over the crosspiece 27 and tooth 28 and then straight off, not through the eye 25. After the loop 13, the tape 10 extends back along itself and passes down through the outer eye 25, then under the crosspiece 27 and back up through the inner eye 26 to lie in a seat 34 formed inward of the tooth 28 on the crosspiece 27, where it is bonded permanently in place by an adhesive or weld. Thus the very end 15 of the tape 10 is completely encased and covered, and is also permanently fixed to the buckle 20.

Figure 16:
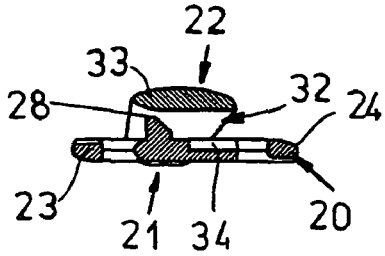
FIG. 16 is a section taken along line XVI-XVI of FIG. 15 with the buckle in a latched position.
Figure 17:
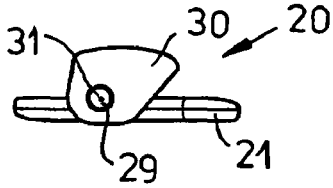
FIG. 17 is a side view of the buckle.
Figure 18:
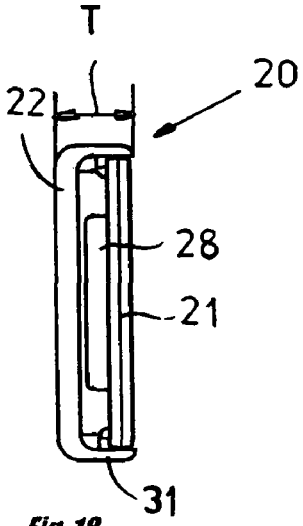
FIG. 18 is an end view taken in the direction of arrow XVIII of FIG. 15.
Figure 15:
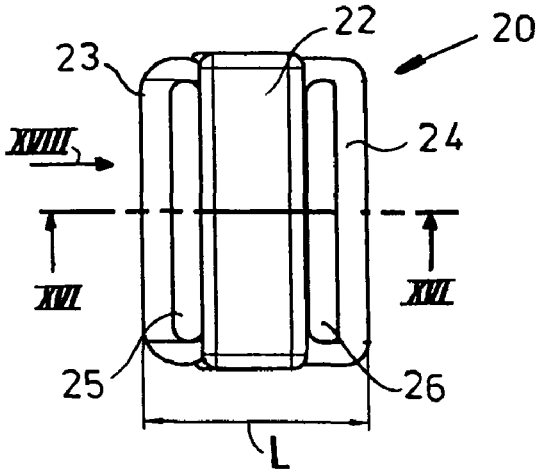
FIG. 15 is a top view of the buckle according to the invention.
Figure 19:
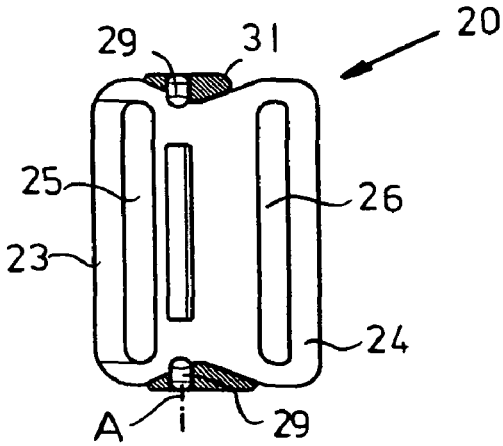
FIG. 19 is a partly sectional bottom view of the buckle.

In the latched position shown in FIGS. 4, 6, and 16 the tooth 28 engages in one of the grooves 11 and the opposite face of the tape 10 is pressed tightly against the underside of the crosspiece 32 of the clamp 22. A perpendicular flank of this groove 10 bears against the perpendicular flank of the tooth 28 so that a tension on the tape 10 away from the buckle 20 in the direction of arrow P (FIG. 4 and 6) will merely pull the clamp 22 into tighter engagement with the tape 10 and hold it every more tightly. Thus the adjuster according to the invention is self-locking and self-tightening in that a tension in the strap or tape 10 will merely clamp it tighter.

The tape 10 itself as shown to the right in FIG. 7 is made of three layers: two outer cushion layers 10*a* of a soft foam or the like that is comfortable against the skin, and a core layer 10*b* of a longitudinally inelastic material, such as a nonstretchable film or mesh, or a rigid tricot tape. This way the tape 10 can be counted on to maintain position and setting, while the standard elastic wings and such of the garment can provide the normal elastic give that is necessary.

To adjust the length of the system of this invention, the user pivots the clamp 22 as shown by arrow D in FIG. 20 (where no tape is shown for clarity of view) opposite the normal tension direction P, so that the distance between the outer end of the tooth 28 and the underside of the crosspiece 32 increases, thereby allowing the tape 10 to be pulled through the buckle opposite to the direction T. In this direction the edges of the grooves 11 engage the angled flank of the tooth 28 and slide easily over it.

In fact pulling the outer (relative to the wearer) portion of the loop 13 away from the buckle can in fact actuate the clamp 22 in this manner. Since this is something that cannot happen accidentally, this is not a problem, and the adjuster will not be able to loosen under normal circumstances. Hence, to loosen the adjuster, which is something that is done in practice much more than tightening it to make up for laundering-related material shrinkage for instance, the user need merely grip the outer part of the loop 13 and the tape 10 between the buckle 20 and the fastened end 14 and pull them apart. When released according to an important feature of the invention, the portion of the tape 10 to the side of the fastened end 14 will pivot back the clamp 22 and relatch the buckle, for the above-mentioned self-locking action.

If the adjuster is to be tightened, the user must manually pivot over the clamp 22 and then hold it in the FIG. 20 position while pulling the entire buckle 20 along the tape 10 toward the fastened outer end 14.

The buckle 20 according to the invention is very flat, of the thickness T (5.25 mm), plus the thickness of the tape 10, which as describe above is less than 1 mm. The buckle 20 is the only hard part of the assembly, and its outer surfaces are very smooth. The step tape 10 itself is fairly flat and can be worn comfortably directly against the skin. Due to the way the tape 10 is threaded back through the buckle 20 and underneath the crosspiece 27 of the base 21, the buckle 20 is largely held out of direct contact with the skin of the user.

We claim:

1. In combination with a brassiere having two wings, a length adjuster for connection between the two brassiere wings, the adjuster comprising:

a longitudinally elongated flexible tape having an outer end adapted for fixing to one of the brassiere wings and formed with a longitudinally extending row of grooves and an inner end;

a buckle having a base formed with at least one seat and an upper face from which projects a tooth, and a clamp having a lower face turned toward the upper face and pivotal on the base between a latched position closely juxtaposed with the tooth and a release position less closely juxtaposed with the tooth, the tape extending through the buckle between the faces with the grooves open toward and fittable with the tooth and with the inner end fixed in the seat, the tape forming a loop to a side of the buckle opposite the outer end; and structure forming an eye through which the loop passes and through which the tape can slide, the clamp in the latched position pressing the tape against the upper face of the base with the tooth fitted in one of the grooves and arresting the tape, the tape being slidable in the release position between the clamp and the base.

2. The combination defined in claim 1 wherein the tooth has an angled flank turned toward the outer end and a substantially perpendicular flank turned toward the loop.

3. The combination defined in claim 2 wherein the clamp is U-shaped and has a crosspiece forming the lower face and a pair of arms forming with the base a pivot.

4. The combination defined in claim 2 wherein the base forms outer and inner eye slots flanking the upper face, the inner end of the tape passing through both of the slots.

5. The combination defined in claim 4 wherein the seat is on the upper face and the base has a lower face normally turned toward a wearer of the brassiere and against which the tape bears.

6. The combination defined in claim 1 wherein the grooves are elongated substantially perpendicular to the tape.

7. The combination defined in claim 6 wherein the tooth is elongated fittable in the grooves.

8. The combination defined in claim 6 wherein the tape is formed with a frame ridge around the grooves.

9. In combination with a brassiere having a pair of back wings, a length adjuster comprising:

a longitudinally elongated flexible tape having an outer end fixed to one of the wings and formed with a longitudinally extending row of grooves and an inner end;

structure connected to the other wing and forming an eye through which the tape is looped;

a buckle having a base formed with at least one seat and an upper face from which projects a tooth, the inner end of the tape being fixed in the seat, and a clamp having a lower face turned toward the upper face and pivotal on the base between a latched position closely juxtaposed with the tooth and a release position less closely juxtaposed with the tooth, the tape extending through the buckle between the faces with the grooves open toward and fittable with the tooth, the clamp in the latched position pressing the tape against the upper face of the base with the tooth fitted in one of the grooves and arresting the tape, the tape being slidable in the release position between the clamp and the base.

10. The length adjuster defined in claim 9 wherein the tooth has an angled flank turned toward the outer end and a substantially perpendicular flank turned toward the loop.

11. The length adjuster defined in claim 10 wherein the clamp is U-shaped and has a crosspiece forming the lower face and a pair of arms forming with the base a pivot.

12. The length adjuster defined in claim 10 wherein the base forms outer and inner eye slots flanking the upper face, the inner end of the tape passing through both of the slots.

13. The length adjuster defined in claim 12 wherein the seat is on the upper face and the base has a lower face normally turned toward a wearer of the brassiere and against which the tape bears.

14. The length adjuster defined in claim 9 wherein the grooves are elongated substantially perpendicular to the tape.

15. The length adjuster defined in claim 14 wherein the tooth is elongated fittable in the grooves.

16. The length adjuster defined in claim 1 wherein the tape is substantially longitudinally inelastic.

17. The length adjuster defined in claim 16 wherein the tape is a laminate having two outer cushion layers and a longitudinally inelastic core.

18. The length adjuster defined in claim 17 wherein the core is made of a nonstretchable mesh.

19. In combination with a brassiere having a pair of back wings, a length adjuster comprising:

a longitudinally elongated flexible tape having an outer end fixed to one of the wings and formed with a longitudinally extending row of transversely elongated grooves and an inner end;

structure connected to the other wing and forming an eye through which the tape is looped;

a buckle having a base formed with at least one seat and an upper face from which projects a tooth having a substantially perpendicular flank directed toward the structure and an angled flank directed toward the one wing, the inner end of the tape being fixed in the seat, and a clamp having a lower face turned toward the upper face and pivotal on the base between a latched position closely juxtaposed with the tooth and a release position less closely juxtaposed with the tooth, the tape extending through the buckle between the faces with the grooves open toward and fittable with the tooth, the clamp in the latched position pressing the tape against the upper face of the base with the tooth fitted in one of the grooves and arresting the tape, the tape being slidable in the release position between the clamp and the base.

* * * * *